US008782857B2

(12) United States Patent
Keyaki et al.

(10) Patent No.: US 8,782,857 B2
(45) Date of Patent: Jul. 22, 2014

(54) SLIDER FOR SLIDE FASTENER

(75) Inventors: Keiichi Keyaki, Toyama (JP); Koji Yamagishi, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 13/821,688

(22) PCT Filed: Sep. 10, 2010

(86) PCT No.: PCT/JP2010/065645

§ 371 (c)(1),
(2), (4) Date: Mar. 8, 2013

(87) PCT Pub. No.: WO2012/032657

PCT Pub. Date: Mar. 15, 2012

(65) Prior Publication Data

US 2013/0160248 A1 Jun. 27, 2013

(51) Int. Cl.
*A44B 19/30* (2006.01)

(52) U.S. Cl.
USPC ..... 24/421

(58) Field of Classification Search
USPC ..... 24/388, 387, 418–421, 423, 424
See application file for complete search history.

(56) References Cited

U.S. PATENT DOCUMENTS

| | | | | |
|---|---|---|---|---|
| 4,422,220 | A * | 12/1983 | Oda | 24/421 |
| 4,768,263 | A * | 9/1988 | Fukuroi et al. | 24/418 |
| 5,031,286 | A | 7/1991 | Kedzierski | |
| 5,896,628 | A | 4/1999 | Oda | |
| 6,588,072 | B1 * | 7/2003 | Lin | 24/421 |
| 6,637,078 | B2 | 10/2003 | Nagata et al. | |
| 7,219,401 | B2 * | 5/2007 | Yamagishi et al. | 24/421 |
| 8,567,019 | B2 * | 10/2013 | Yamamoto et al. | 24/419 |
| 2002/0000025 | A1 | 1/2002 | Yamagishi | |
| 2002/0152591 | A1 | 10/2002 | Nagata et al. | |
| 2005/0125967 | A1 | 6/2005 | Yamagishi et al. | |

FOREIGN PATENT DOCUMENTS

| | | | |
|---|---|---|---|
| BR | 9702968 | A | 7/1999 |
| BR | 103331 | A | 6/2001 |
| CA | 2217082 | A | 3/1998 |
| CA | 2351507 | A | 12/2001 |

(Continued)

OTHER PUBLICATIONS

International Search Report, PCT Application No. PCT/JP2010/065645, mailed Nov. 16, 2010.

(Continued)

*Primary Examiner* — Robert J Sandy
*Assistant Examiner* — Rowland Do
(74) *Attorney, Agent, or Firm* — Kilpatrick Townsend & Stockton LLP

(57) ABSTRACT

A slider with a stop mechanism includes a slider body having first and second post positions on an upper blade, a pull tab, and a bent leaf spring member. The leaf spring member includes first and second restraining portions which abut against the first and second post positions, respectively, to restrain upward movement. The first and second restraining portions are respectively disposed at positions to be spaced apart from the first and second post positions when the inclined angle $\alpha$ of the pull tab is 0°. The first restraining portion is disposed in a relation to abut against the first portion and thus restrain the upward movement, when the inclined angle $\alpha$ is in a range of $0° < \alpha < 180°$ or when the axis of the pull tab is spaced apart from the upper blade.

5 Claims, 7 Drawing Sheets

(56) References Cited

FOREIGN PATENT DOCUMENTS

| | | | |
|---|---|---|---|
| CN | 1179290 | A | 4/1998 |
| CN | 1329860 | A | 1/2002 |
| CN | 1382406 | A | 12/2002 |
| CN | 1628569 | A | 6/2005 |
| DE | 69712847 | | 12/2002 |
| DE | 69712847 | T | 12/2002 |
| DE | 60103816 | | 7/2005 |
| DE | 60103816 | T | 7/2005 |
| EP | 832574 | A1 | 4/1998 |
| EP | 1166675 | A1 | 1/2002 |
| EP | 1262115 | A2 | 12/2002 |
| ES | 2173361 | T | 10/2002 |
| ES | 2219456 | T | 12/2004 |
| HK | 1006636 | A | 2/2004 |
| HK | 1040596 | A | 4/2005 |
| HK | 1048421 | A | 1/2007 |
| ID | 18373 | A | 4/1998 |
| ID | 30591 | A | 1/2002 |
| JP | S62-290829 | | 12/1987 |
| JP | 10-99107 | A | 4/1998 |
| JP | 2002-315609 | A | 4/1998 |
| JP | 2003-277890 | | 10/2003 |
| JP | 3599644 | B2 | 12/2004 |
| JP | 2005-176910 | A | 7/2005 |
| JP | 2008-161246 | | 7/2008 |
| KR | 10-0243725 | B | 3/2000 |
| KR | 10-2002-0002272 | A | 1/2002 |
| KR | 10-2002-0082146 | A | 10/2002 |
| SG | 64444 | A | 4/1999 |
| TR | 9701085 | A | 6/1999 |
| TW | 518941 | Y | 1/2003 |
| TW | 576720 | B | 2/2004 |

OTHER PUBLICATIONS

Office Action, Japanese Patent Application No. 2012-532820, mailed Nov. 6, 2013.

* cited by examiner

SLIDER FOR SLIDE FASTENER

This application is a national stage application of PCT/JP2010/065645 which is incorporated herein by reference.

TECHNICAL FIELD

The present invention relates to a slider for a slide fastener including a stop mechanism, and more particularly, to a slider of which a leaf spring member having a stopper claw is fitted into a slider body using its resilience.

BACKGROUND ART

Generally, slide fasteners are attached to openings of various products such as clothing or bags, and left and right element rows are engaged or disengaged by sliding a slider, which is disposed on the slide fastener, to open or close the opening. Also, there is known a slider for use in the slide fastener including a stop mechanism for retaining the slider at a stop position when the slider is stopped at any position on the element rows.

For example, Japanese Patent Application Publication No. 2005-176910A (Patent Document 1) discloses a slider 100 with a stop mechanism as described above. As illustrated in FIG. 13, the slider 100 disclosed in Patent Document includes three components, that is, a slider body 90, a pull tab 110, and a leaf spring member 80.

The pull tab 110 has a pull tab body 111 to be pinched by fingers at operation of the slider 100, and an axis 112 disposed at one end portion of the pull tab body 111 and having a cam-shaped cross section. For Patent Document 1, the axis 112 of the pull tab 110 is configured to be shifted downward with respect to the pull tab body 111 when the pull tab 110 lies down toward a rear mouth of the slider body 90.

The leaf spring member 80 disclosed in Patent Document 1 has a fallen shape, and has a middle plate portion 81, a drooping piece 82 extending from a front end portion of the middle plate portion 81, and a locking claw 83 extending downward from a rear end portion of the middle plate portion 81. Also, an upper-surface window portion 84 is opened in the middle plate portion 81, and an inclined tongue portion 85 extends forward and downward from an opened edge of a rear side of the upper-surface window portion 84. A first window portion 86 is opened in the tongue portion 85, and a second window portion 87 is opened from the middle plate portion 81 to the locking claw 83. A proximal end of the drooping piece 82 is provided with a projection (not illustrated) projecting in a width direction.

The slider body 90 disclosed in Patent Document 1 has an upper blade 91, a lower blade 92, and a connecting post 93 for connecting front end portions of the upper blade 91 and the lower blade 92. Left and right shoulder mouths are disposed at a front end portion of the slider body 90, with the connecting post 93 being interposed between the shoulder mouths, and a rear mouth is disposed at a rear end portion of the slider body 90. An element guide passage 95 communicating the left and the right shoulder mouths and the rear mouth is formed between the upper and lower blades 91 and 92.

The upper blade 91 has a first post portion 91a standing up from its front end portion, and a second post portion 91b standing up from a rear position with respect to the first post portion 91a. A portion at the rear side of the first post portion 91a is provided with an insertion hole 91c into which the tongue portion 85 of the leaf spring member 80 is inserted, and a portion at the rear side of the second post portion 9b is provided with a claw hole 91d into which the locking claw 83 of the leaf spring member 80 is inserted. Also, the front end portion of the first post portion 91a has a protrusion 91e disposed at a center portion in the width direction, and abutment portions (not illustrated) disposed at both left and right sides of the protrusion 91e and abutting against the tongue portion 85 of the leaf spring member 80. In this instance, a tip end surface of the abutment portion is disposed in a direction perpendicular to an upper surface of the upper blade 91.

A front-end groove 96 is disposed at the front end (front side of the guide post) of the slider body 90, and the drooping piece 82 of the leaf spring member 80 is inserted into the front-end groove. A locking portion (not illustrated) protrudes forward from an inner lower end portion of the front-end groove 96, and the projection of the drooping piece 82 is locked to the locking portion.

When the slider 100 including the components as described above is assembled, the axis 112 of the pull tab 110 is set on the upper surface of the upper blade 91, and then the tongue portion 85 and the locking claw 83 of the leaf spring member 80 are respectively inserted into the insertion hole 91c and the claw hole 91d of the upper blade 91. Then, while the tongue portion 85 of the leaf spring member 80 is pressed against the abutment portion of the first post portion 91a which is disposed at the upper blade 91, the drooping piece 82 of the leaf spring member 80 is inserted into the front-end groove 96 of the slider body 90. In addition, as the leaf spring member 80 is resiliently deformed and the drooping piece 82 is pushed down, the projection of the drooping piece 82 is engaged with the locking portion of the slider body 90. Accordingly, the leaf spring member 80 is fitted into the slider body 90 to assemble the slider 100, as illustrated in FIG. 13.

According to the slider 100 disclosed in Patent Document 1 which is assembled by the above process, if the pull tab 110 lies down toward the rear mouth (rear side), the locking claw 83 of the leaf spring member 80 moves in the element guide passage 95 of the slider body 90. For this reason, if the slider fastener includes such a slider 100, the locking claw 83 is inserted and locked between the fastener elements of the element row when the pull tab 110 lies down backward, so that the slider 100 can be retained at a stop position with respect to the element row.

If the pull tab 110 of the slider 100 stands up with respect to the upper surface of the upper blade 91, the middle plate portion 81 of the leaf spring member 80 is lifted up against the resilient force of the leaf spring member 80 by the axis 112 of the pull tab 110. Therefore, the bent portion can be resiliently deformed at the drooping piece 82 of the leaf spring member 80, and the locking claw 83 can be retracted from the element guide passage 95. For this reason, the slider 100 can be freely slid with respect to the element row.

If the pull tab 110 lies down toward the shoulder mouths (front side), since the axis 112 of the pull tab 110 is shifted with respect to the pull tab body 111, the middle plate portion 81 of the leaf spring member 80 is maintained in the lifted state by the axis 112 of the pull tab 110, so that the slider 100 can be freely slid.

PRIOR ART DOCUMENT

Patent Document

Patent Document 1: Japanese Patent Application Publication No. 2005-176910A

SUMMARY OF INVENTION

Problems to be Solved by Invention

In the slider 100 disclosed in Patent Document 1, as described above, the tongue portion 85 of the leaf spring member 80 is brought in contact with the first post portion 91a of the upper blade 91 by pressurizing, and, simultaneously, the drooping piece 82 of the leaf spring member 80 is engaged with the locking portion provided on the front-end groove 96 of the slider body 90, so that the leaf spring member is fitted into the slider body 90 by the resilient force of the leaf spring member 80.

With the slider 100 disclosed in Patent Document 1, in order to prevent the leaf spring member 80 from being released from the slider body 90, for example, even though the pull tab 110 is pulled, the front end of the second post portion 91b disposed on the upper blade 91 is loosely fitted into the second window portion 87 of the leaf spring member 80, and the lower opened edge of the second window portion 87 which is opened in the leaf spring member 80 can abut against the lower surface of the front end portion of the second post portion 91b disposed on the upper blade 91.

That is, with the slider 100 disclosed in Patent Document 1, for example, in order to move the axis 112 of the pull tab 110 from the upper surface of the upper blade 91, when the pull tab 110 is strongly pulled and thus the leaf spring member 80 is lifted up, the lower opened edge of the second window portion 87 of the leaf spring member 80 can abut against the lower surface of the front end portion of the second post portion 91b. Accordingly, since the lifted height of the leaf spring member 80 is restricted, the slider 100 disclosed in Patent Document 1 can prevent the leaf spring member 80 from being released from the slider body 90.

For example, in the slide fastener attached to clothing or the like, whenever the slide fastener is closed in a case where the clothing is tight, the pull tab may be strongly pulled and thus be slid in a direction to engage the left and right element rows.

If the slider 100 disclosed in Patent Document 1 is used for the slide fastener attached to such clothing, the lower opened edge of the second window portion 87 of the leaf spring member 80 abuts against the lower surface of the front end portion of the second post portion 91b, thereby preventing the leaf spring member 80 from being released from the slider body 90. However, for example, when the pull tab 110 is further strongly pulled from the state in which the lower opened edge of the second window portion 87 of the leaf spring member 80 against the second post portion 91b, the leaf spring member 80 is applied by stress from the axis 112 of the pull tab 110, and thus the bent portion of the drooping piece 82 in the leaf spring member 80 is significantly resiliently deformed, so that the bent portion is excessively deformed.

In the operation (in particular, closing operation) of the slider 100, if the bent portion of the leaf spring member 80 is repeatedly significantly deformed by strongly pulling the pull tab 110, the leaf spring member 80 is quickly deteriorated. As a result, a stop mechanism of the slider 100 may not be normally operated. In addition, the leaf spring member 80 is plastically deformed, so that the leaf spring member will be detached from the slider body 90.

The present invention has been made in view of the above-described problem, and an object of the present invention is to provide a slider for a slide fastener with a stop mechanism, which can suppress deterioration of a leaf spring member even if a pull tab is repeatedly strongly pulled, thereby maintaining a normal operation of the stop mechanism and thus reliably using it for a long time.

Means for Solving Problems

In order to achieve the above object, there is provided a slider for a slide fastener with a stop mechanism, comprising: a slider body having upper and lower blades and a guide post for connecting front end portions of the upper and lower blades; a pull tab having an axis; and a bent leaf spring member, wherein the upper blade includes a claw hole formed at a side of a rear mouth of the slider body, a first post portion standing up at a front side with respect to the claw hole, and a second post portion standing up at a rear side with respect to the first post portion, wherein the leaf spring member includes a substrate portion pushing the axis of the pull tab from an upper side, a stopper claw portion extending from a rear end portion of the substrate portion, and a tongue portion extending downward from the substrate portion, and the leaf spring member is fitted into the slider body such that the stopper claw portion is able to be inserted into or released from an element guide path of the slider body by rotation of the pull tab, wherein the leaf spring member includes a first restraining portion which is disposed at the tongue portion and abuts against the first post portion to restrain upward movement of the leaf spring member, and a second restraining portion which is disposed on the substrate portion at a side of the stopper claw portion with respect to the tongue portion, and abuts against the second post portion to restrain the upward movement of the leaf spring member, wherein if an inclined angle of the pull tab with respect to an upper surface of the upper blade is defined as 0° when the pull tab lies down backward, the first and second restraining portions are respectively disposed at positions to be spaced apart from the first and second post portions when the inclined angle $\alpha$ is 0°, and wherein the first restraining portion is disposed in a relation to abut against the first post portion and thus restrain the upward movement, when the inclined angle $\alpha$ of the pull tab is in a range of $0° < \alpha < 180°$, or when the axis of the pull tab is spaced apart from the upper blade.

In the slider for the slide fastener according to the present invention, the second restraining portion is preferably disposed in a relation to abut against the second post portion and thus restrain the upward movement, when the pull tab is operated to further lift up the substrate portion of the leaf spring member from a state in which the first restraining portion abuts against the first post portion and thus the upward movement is restrained.

The second restraining portion may be disposed in a relation in which, when the pull tab is operated, the first restraining portion abuts against the first post portion to restrain the upward movement, and, simultaneously, the second restraining portion abuts against the second post portion to restrain the upward movement.

In the slider for the slide fastener according to the present invention, it is preferable that front end portions of the first and second post portions are bent, a first window portion is opened in the tongue portion, and a second window portion is opened in the substrate portion at the side of the stopper claw portion with respect to the tongue portion, the front end portions of the first and second post portions are loosely inserted into the first and second windows of the leaf spring member, respectively, and the first and second restraining portions are respectively configured by lower opened edges of the first and second windows.

In the slider for the slide fastener according to the present invention, it is preferable that the leaf spring member is made of stainless steel having yield strength of 1500N or more. Also, the leaf spring member is preferably made of stainless steel having hardness of 430 Hv or more and 500 Hv or less. Further, the leaf spring member preferably has magnetic permeability of 1.005 or less.

Advantageous Effects of Invention

According to the slider for the slide fastener of the present invention, the upper blade of the slider body includes the claw hole formed at the side of the rear mouth of the slider body, the first post portion standing up at the front side with respect to the claw hole, and the second post portion standing up at a rear side with respect to the first post portion. The leaf spring member of the slider includes the substrate portion pushing the axis of the pull tab from an upper side, the stopper claw portion extending from the rear end portion of the substrate portion, the tongue portion extending downward from the substrate portion, the first restraining portion which is disposed at the tongue portion and abuts against the first post portion to restrain upward movement of the leaf spring member, and the second restraining portion which is disposed on the substrate portion at the side of the stopper claw portion with respect to the tongue portion, and abuts against the second post portion to restrain the upward movement of the leaf spring member. Further, the stopper claw portion is able to be inserted into or released from the element guide path of the slider body by the rotation of the pull tab.

Further, the slider is configured so that if the inclined angle $\alpha$ of the pull tab with respect to an upper surface of the upper blade is defined as 0° when the pull tab lies down backward (lies down toward a rear mouth), the first and second restraining portions are respectively disposed at positions to be spaced apart from the first and second post portions when the inclined angle $\alpha$ is 0°. When the inclined angle $\alpha$ is 0°, a gap is formed between the first and second restraining portions of the leaf spring member, and the first and second post portions. As a result, for example, even in the case where a tolerance occurs in the component dimensions of the slider body or the leaf spring member, the leaf spring member can be smoothly inserted into the slider body without being caught by the latter, thereby reliably assembling the slider.

In addition, the slider is configured so that the first restraining portion is disposed in a relation to abut against the first post portion and thus restrain the upward movement, when the inclined angle $\alpha$ of the pull tab is in a range of $0° < \alpha < 180°$, or when the axis of the pull tab is spaced apart from the upper blade. In this way, if the slider is configured so that the first restraining portion provided on the tongue portion abuts against the first post portion to restrain the upward movement, when the pull tab is operated so that the inclined angle $\alpha$ of the pull tab is in the range of $0° < \alpha < 180°$, or when the axis of the pull tab is spaced apart from the upper blade, for example, when the pull tab is strongly pulled, the first restraining portion abuts against the first post portion to restrain the lifting height of the leaf spring member, thereby reliably preventing the leaf spring member from being released from the slider body.

In particular, according to the slider of the present invention, if the substrate portion of the leaf spring member is lifted up against the resilient force of the leaf spring member by the axis of the pull tab, the substrate portion (in particular, the front end portion of the substrate portion) of the leaf spring member is mainly resiliently deformed. Therefore, the first restraining portion abuts against the first post portion at the front-side position adjacent to the bent portion of the leaf spring member with respect to the portion of the leaf spring member against which the axis of the pull tab abuts, thereby effectively suppressing a resilient deformation amount for the bent portion of the leaf spring member.

Accordingly, the slider of the present invention can reduce the resilient deformation (strain) of the bent portion of the leaf spring member when the leaf spring member is lifted up by the axis of the pull tab, for example, as compared to a slider of the related art in which the leaf spring member abuts against the bottom surface of the front end portion of the second post at the rear-side position with respect to the portion of the spring member against which the axis of the pull tab against, like Patent Document 1. As a result, the slider can reliably withstand tensile stress applied from the pull tab.

As a result, even though the pull tab of the slider is repeatedly strongly pulled, the upward movement of the first restraining portion is restrained, thereby effectively suppressing deterioration of the leaf spring member. The slider can be reliably used for a long time, without having a problem in that the stop mechanism is not normally operated (e.g., poor lock) or the leaf spring member is released from the slider body.

In the slider of the present invention, the second restraining portion is disposed at the relation to abut against the second post portion and thus restrain the upward movement, when the pull tab is operated to further lift up the substrate portion of the leaf spring member from a state in which the first restraining portion abuts against the first post portion and thus the upward movement is restrained. Therefore, even though the pull tab is strongly pulled from the state in which the first restraining portion abuts against the first post portion, it is possible to prevent the substrate portion of the leaf spring member from being lifted in a desired height or more. As a result, the leaf spring member is prevented from being excessively deformed, thereby further effectively suppressing the deformation of the leaf spring member and preventing the leaf spring member from being plastically deformed.

Meanwhile, in the present invention, the second restraining portion is disposed in the relation in which, when the pull tab is operated, the first restraining portion abuts against the first post portion to restrain the upward movement, and, simultaneously, the second restraining portion abuts against the second post portion to restrain the upward movement. In this way, since the deformation of the leaf spring member is further reliably suppressed to be small when the leaf spring member is lifted up by the axis of the pull tab, it is possible to effectively suppress the deformation of the leaf spring member and prevent the leaf spring member from being plastically deformed.

In the slider for the slide fastener of the present invention, the front end portions of the first and second post portions are bent, the first window portion is opened in the tongue portion, and a second window portion is opened in the substrate portion at the side of the stopper claw portion with respect to the tongue portion, the front end portions of the first and second post portions are loosely inserted into the first and second windows of the leaf spring member, respectively, and the first and second restraining portions are respectively configured by the lower opened edges of the first and second windows.

With the configuration of the first and second restraining portions, when the lower opened edge of the first window portion which is the first restraining portion abuts against the bottom surface of the front end portion of the first post portion, the tongue portion having the first restraining portion is reliably restrained from being moved upward, thereby effectively suppressing the substrate portion of the leaf spring member from being lifted upward. Further, when the lower opened edge of the second window portion which is the second restraining portion abuts against the bottom surface of the front end portion of the second post portion, the second restraining portion is reliably restrained from being moved upward, thereby effectively suppressing the substrate portion of the leaf spring member from being lifted upward together with the first restraining portion.

In the slider for the slide fastener of the present invention, the leaf spring member is made of stainless steel having yield strength of 1500N or more. Accordingly, since the leaf spring has the yield strength of 1500N or more, it is possible to prevent the leaf spring member from being plastically deformed when the pull tab is strongly pulled or an impulsive force is applied to the leaf spring member. Therefore, it is possible to prevent a problem of the stop mechanism, such as poor lock. In this instance, in order that the leaf spring member is reliably formed to have a desired shape, stainless steel having the yield strength of 1800N or less, in particular, 1700N or less, is used as the stainless steel configuring the leaf spring member.

Also, in the slider, the leaf spring member is made of stainless steel having hardness of 430 Hv or more and 500 Hv or less. If the hardness of the leaf spring member is 430 Hv or more, the yield strength of 1500N or more can be reliably obtained. In addition, if the hardness of the leaf spring member is 500 Hv or less, when a sheet of stainless steel is molded by pressing, the leaf spring member is molded without damaging a mould or the like, and it does not exert an adverse effect on a lifetime of the mould.

Further, the leaf spring member has magnetic permeability of 1.005 or less. In fastener adhered products to which the slide fastener is attached, after a sewing process of the fastener attached product is performed, a detection process for detecting a broken needle, which is mixed in the sewing process, by an inspection meter using magnetism is usually performed. In this instance, the slider for use in the slide fastener is required to cope with the inspection meter so that the inspection meter does not wrongly detect the leaf spring member of the slider in the detection process. Therefore, the present invention can configure the slider capable of coping with the inspection meter, since the leaf spring member has the magnetic permeability of 1.005 or less to prevent the leaf spring member of the slider from being detected by the inspection meter.

EMBODIMENTS OF INVENTION

A description will be in detail given below of a preferable mode for carrying out the invention by listing up embodiments with reference to the accompanying drawings. In this case, the invention is not limited to the embodiments described below at all, but can be variously modified as long as it has substantially the same structure as the invention, and achieves the same operation and effect.

Embodiment 1

Figure 1:
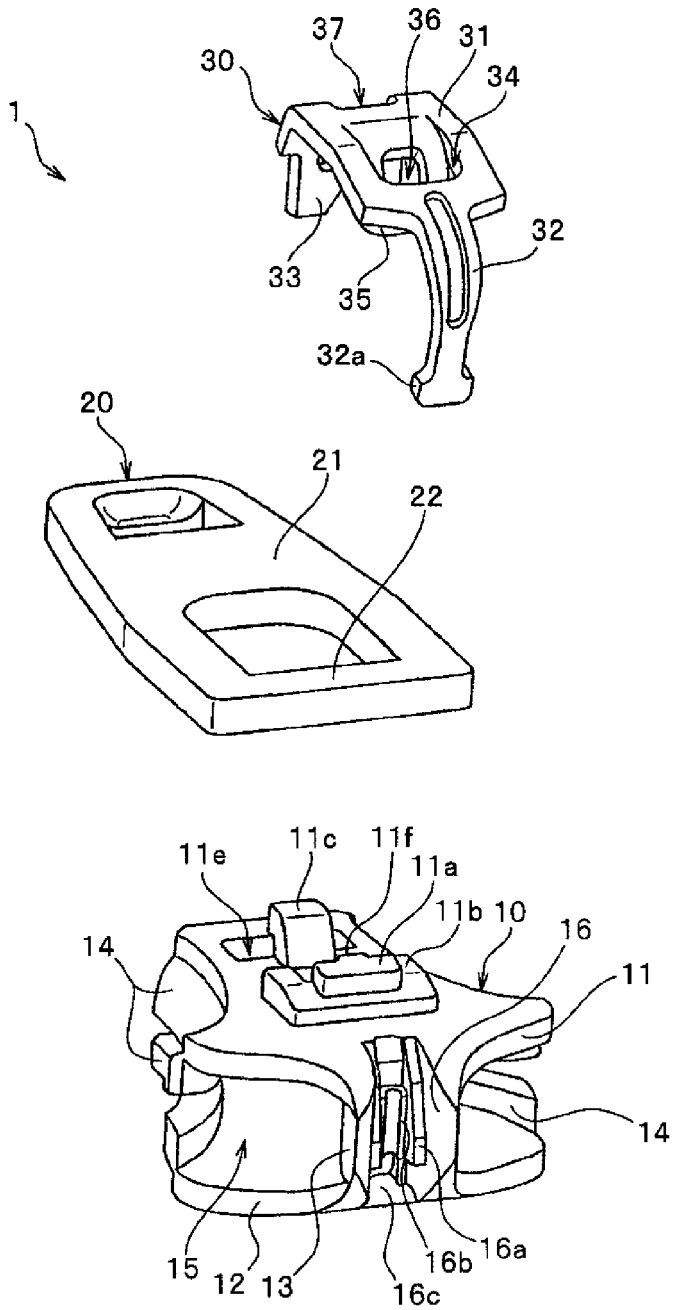
FIG. 1 is a perspective view illustrating a slider for a slide fastener according to a first embodiment of the present invention.
Figure 2:
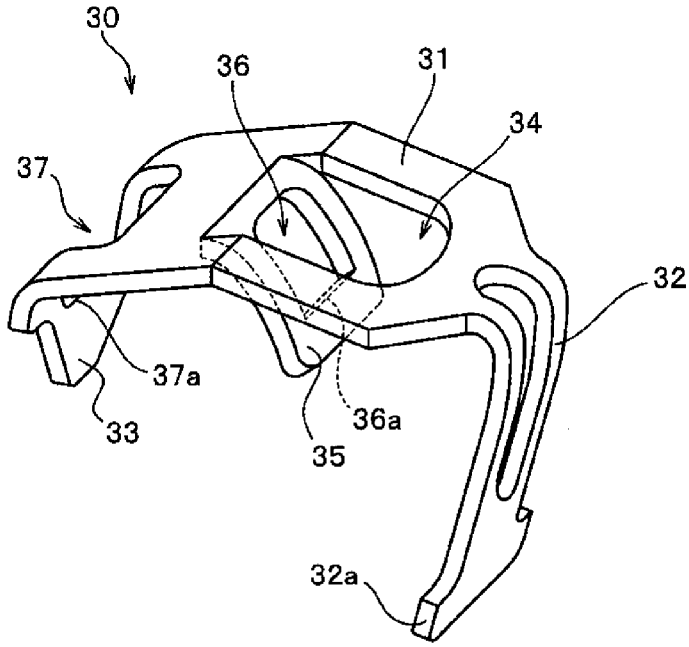
FIG. 2 is a perspective view illustrating a leaf spring member configuring the slider.
Figure 3:
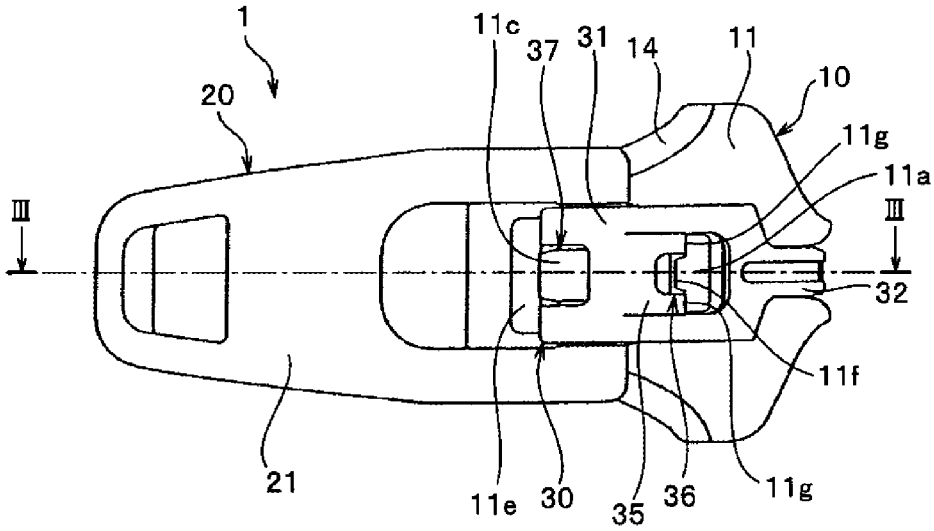
FIG. 3 is a plan view of the slider when a pull tab lies down toward a rear mouth.
Figure 4:
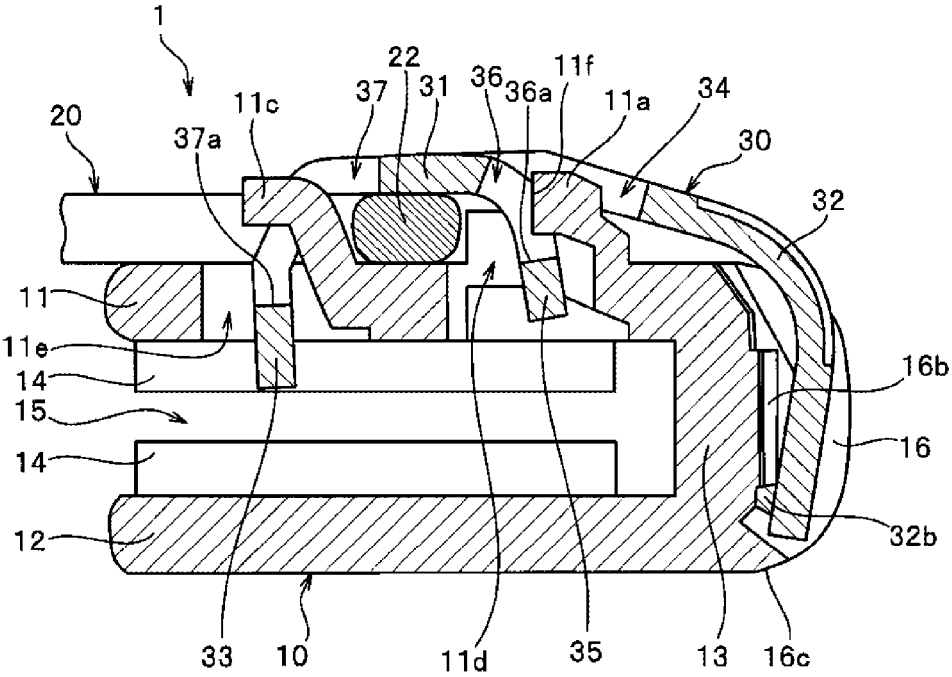
FIG. 4 is a cross-sectional view taken along the line III-III in FIG. 3.

FIG. 1 is a perspective view illustrating a slider for a slide fastener according to a first embodiment of the present invention. FIG. 2 is a perspective view illustrating a leaf spring member configuring the slider. FIG. 3 is a plan view of the slider when a pull tab lies down toward a rear mouth. FIG. 4 is a cross-sectional view taken along the line III-III in FIG. 3.

In the following description, a back and forth direction of the slider means a direction which is in parallel to a sliding direction (length direction) of the slider. In particular, a side in which shoulder mouths of the slide are disposed is referred to as forward, and a side in which a rear mouth of the slide is disposed is referred to as backward. Also, a width direction of the slider means a left and right direction. An opposite direction (height direction) of upper and lower blades of the slider means an upward and downward direction. In particular, a side in which a pull tab is disposed with respect to the slider body is referred to as upward, and the opposite side is referred to as downward.

Furthermore, an inclined angle $\alpha$ of the pull tab with respect to an upper surface of the upper blade is defined as 0° when the pull tab lies down toward the rear mouth (backward side), is defined as 180° when the pull tab lies down toward the shoulder mouths (forward side), and is defined as 90° when the pull tab stands up in a direction perpendicular to the upper surface of the upper blade.

In the slider 1 for a slider fastener according to the first embodiment is a slider including a stop mechanism employing a stopper claw portion 33 which will be described later, and is usually used for a slide fastener which is attached to clothing such as jeans, or a bag. The slider 1 includes three components, that is, a slider body 10, a pull tab 20 rotatably attached to the slider body 10, and a leaf spring member 30 fitted into the slider body 10. In this instance, the slide cover body 10 and the pull tab 20 are manufactured by pressing a metallic sheet such as cooper zinc alloy.

The slider body 10 of the first embodiment has an upper blade 11, a lower blade 12, a guide post 13 for connecting front end portions of the upper and lower blades 11 and 12, and flanges 14 which are arranged in right and left side edges of the upper and lower blades 11 and 12. A rear mouth is formed in a rear end portion of the slide body 10, and shoulder mouths are formed in a front end portion of the slider 1 or both right and left sides of the guide post 13. Further, a substantially Y-shaped element guide path 15 communicating the right and left shoulder mouths and the rear port is formed between the upper and lower blades 11 and 12.

The upper blade 11 of the slider body 10 is provided with a first post portion 11*a* protruding from the front end portion of the upper blade 11, a support portion 11*b* elevated from an upper surface of the upper blade 11 to enclose a proximal end portion (end portion of the upper blade 11) of the first post portion 11*a*, and a second post portion 11*c* protruding from a rear position with respect to the first post portion 11*a*.

An insertion hole 11*d* for receiving a tongue portion 35 (will be described later) of the leaf spring member 30 is made in a rear side of the proximal end portion of the first post portion 11*a* on the upper blade 11, and a claw hole 11*e* for receiving a stopper claw portion 33 (will be described later) of the leaf spring member 30 is made in the rear side of the proximal end portion of the second post portion 11*c*.

The first post portion 11*a* stands up from the upper surface of the upper blade 11, and its front end is formed in a hook shape which is bent rearward. Further, the front end portion of the first post portion 11*a* has, as illustrated in FIG. 3, a protrusion 11*f* disposed at a center portion in a width direction, and an abutment portion 11*g* which is disposed at both right and left sides of the protrusion 11*f* and abuts against the tongue portion 35 of the leaf spring member 30.

In this instance, the front end surface of the abutment 11*g* is disposed in a direction perpendicular to the upper surface of the upper blade 11. The support portion 11*b* is disposed at the front side of the first post portion 11*a* and right and left lateral portions of the first post portion 11*a*. The support portion 11*b* is configured to support a substrate portion 31 (will be described later) of the leaf spring member 30 when the leaf spring member 30 is fitted into the slider body 10.

The second post portion 11*c* stands up to be inclined rearward from the upper surface of the upper blade 11 at a position between the insertion hole 11*d* and the claw hole 11*e*, and is formed in a hook shape which is bent rearward so that its front end portion is substantially parallel with the upper surface of the upper blade 11. The insertion hole 11*d* and the claw hole 11*e* formed in the upper blade 11 penetrate from the upper surface of the upper blade 11 to the element guide path 15. Also, widthwise sizes of the insertion hole 11*d* and the claw hole 11*e* are set so that the tongue portion 35 of the leaf spring member 30 and the stopper claw portion 33 can be respectively inserted.

The front end portion of the slider body 10 is provided concavely with a front end groove 16 along the right and left direction. The front end groove 16 is disposed between the right and left shoulder mouths so that its groove width (interval between right and left wall surfaces in the front end groove 16) is gradually increased. Also, the front end groove 16 is provided therein with a pair of first right and left locking portions 16*a* protruding forward in a substantially right-angled triangular shape from a bottom surface of the front end groove 16, and a second locking portion 16*b* protruding between the right and left first locking portions 16*a* in a protruding height from the bottom surface lower than the first locking portion 16*a*.

The lower end of the front end groove 16 is provided with a lower wall portion 16*c*, and a bottom surface of the lower wall portion 16*c* is formed to be along the bottom surface of the lower blade 12. Accordingly, even though an obstacle (e.g., fabric of clothing) exists at the side of the lower blade 12 of the slider 1 when the slider 1 is slid, it is possible to prevent the front end groove 16 of the slider 1 from being caught by the obstacle, thereby smoothly performing the sliding operation of the slider 1.

The pull tab 20 of the first embodiment includes a pull tab body 21 to be pinched by fingers at operation of the slider 1, and an axis 22 disposed at one end portion of the pull tab body 21 and having a cam-shaped cross section. Also, the pull tab 20 of the first embodiment is configured so that a center surface of the pull tab body 21 in a thickness direction thereof is disposed flush with a center surface of the axis 22 in a thickness direction thereof.

The leaf spring member 30 of the first embodiment is formed such that a longitudinal section is bent in a substantially C-shape. The leaf spring member 30 has a substrate portion 31 for pushing the axis 22 of the pull tab 20 upward, a drooping piece 32 extending from a front end portion of the substrate portion 31, and a stopper claw portion 33 which is able to be inserted and released from an element guide path 15 of the slide body 10.

On the substrate portion 31, the upper-surface window portion 34 is opened, and the tongue portion 35 inclined downward toward the front extends from a rear opened edge of the upper-surface window portion 34. The first window portion 36 is opened in the tongue portion 35, and at the side of the stopper claw portion 33 with respect to the tongue portion 35 of the substrate portion 31, a second window portion 37 is opened from the substrate portion 31 to the stopper claw portion 33.

The drooping piece 32 of the leaf spring member 30 has a bent portion which is formed to have a width narrower than the substrate portion 31 and is extended and bent downward from the substrate portion 31, and a front end portion straightly pending from the front end of the bent portion. Also, the front end portion of the drooping piece 32 is provided on its lower end with a first boss 32*a* protruding in a right and left direction and a second boss 32*b* protruding in a rearward direction. These first and second bosses 32*a* and 32*b* are configured to be respectively locked to the first and second locking portions 16*a* and 16*b* protruding from the inside of the front end groove 16 of the slide body 10, when they are fitted into the slider body 10 as described above.

The first window portion 36 opened in the leaf spring member 30 of the first embodiment is adapted to have a widthwise opening size larger than a widthwise size (width dimension) of the protrusion 11*f*, in order to loosely fit the protrusion 11*f* disposed on the first post portion 11*a* of the slider body 10 in the case where the leaf spring member 30 is fitted into the slider body 10, as described above.

A lower opened edge 36*a* of the first window portion 36 is disposed at a position to be spaced apart from the first post portion 11*a* when the pull tab 20 lies down backward at its inclined angle $\alpha$ of 0° or when the pull tab 20 lies down forward at its inclined angle $\alpha$ of 180°.

Further, the lower opened edge 36*a* of the first window portion 36 is disposed at a position in which the lower opened edge 36*a* abuts against the bottom surface of the front end portion (protrusion 110 of the first post portion 11*a* when the pull tab 20 is operated in a range of $0° < \alpha < 180°$, preferably, $30° < \alpha < 150°$. Accordingly, the lower opened edge 36*a* of the first window portion 36 abuts against the bottom surface of the front end portion of the first post portion 11*a* when the pull tab 20 is operated in the range, which functions as a first restraining which restrains the movement of the lower opened edge 36*a* to a position higher than the abutment position.

The second window portion 37 opened to the rear side with respect to the upper-surface window portion 34 of the substrate portion 31 is adapted to have a widthwise opening size larger than the width dimension of the front end portion of the second post portion 11*c*, in order to loosely fit the front end portion of the second post portion 11*c* when the slider is assembled.

A lower opened edge 37*a* of the second window portion 37 is disposed at a position to be spaced apart from the second post portion 11*c* when the pull tab 20 lies down backward at its inclined angle $\alpha$ of 0° or when the pull tab 20 lies down forward at its inclined angle $\alpha$ of 180°. Further, the lower opened edge 37*a* of the second window portion 37 is disposed at a position in which the lower opened edge 37*a* abuts against the bottom surface of the front end portion of the second post portion 11*c* when the pull tab 20 is operated to further lift the substrate portion 31 of the leaf spring member 30 from the state in which the lower opened edge 36*a* of the first window portion 36 abuts against the first post 11*a*, and thus the axis 22 of the pull tab 20 is spaced apart from the upper surface of the upper blade 11. Accordingly, the lower opened edge 37*a* of the second window portion 37 abuts against the bottom surface of the front end portion of the second post portion 11*c* when the axis 22 of the pull tab 20 is separated from the upper surface of the upper blade 11, which functions as a second restraining which restrains the movement of the lower opened edge 37*a* to a position higher than the abutment position.

In particular, in the first embodiment, when the pull tab 20 lies down backward or lies down forward, a spaced distance between the lower opened edge 37*a* of the second window portion 37 and the bottom surface of the front end portion of the second post portion 11*c* is set as two times or more, preferably, 3 times or more, as large as a spaced distance between the lower opened edge 36*a* of the first window portion 36 and the bottom surface of the front end portion of the first post portion 11*a*.

In this instance, the leaf spring member 30 of the first embodiment is made of stainless steel having yield strength of 1500N or more. As a material of the leaf spring member according to the related art, stainless steel having yield strength of about 1000N to about 1200N is used to easily mold a wanted shape by pressing, but the leaf spring member 30 is manufactured by shaping the stainless steel having the yield strength of 1500N through pressing in the first embodiment.

Accordingly, in the slider of the first embodiment, since it is hard to plastically deform the leaf spring member 30 when the pull tab 20 is strongly pulled or an impulsive force is applied to the leaf spring member 30, it is possible to prevent a problem of the stop mechanism, such as poor lock. In order that the leaf spring member 30 is reliably molded by pressing to have a wanted shape, stainless steel having the yield strength of 1800N or less, in particular, 1700N or less, is used as the stainless steel configuring the leaf spring member 30 according to the first embodiment.

Further, the stainless steel configuring the leaf spring member 30 has hardness from 430 Hv to 500 Hv. If the hardness of the leaf spring member 30 is 430 Hv or more, it can reliably obtain the yield strength of 1500N or more. Also, if the hardness of the leaf spring member 30 is 500 Hv or less, the leaf spring member 30 can be reliably formed without damaging a mould, when a sheet of stainless steel is subjected to press machining.

In addition, the leaf spring member 30 is configured such that a magnetic permeability is 1.005 or less in order to cope with an inspection meter.

Next, a method for assembling the slider 1 including three components described above will now be described.

First, the pull tab 20 is set on the upper surface of the upper blade 11 of the slider body 10. In this instance, the axis 22 of the pull tab 20 is inserted between the first post portion 11*a* (and support portion 11*b*) and the second post portion 11*c* of the slide body 10, and the pull tab 20 is maintained in the state in which the pull tab 20 lies down toward the rear mouth.

The leaf spring member 30 is set on the slider body 10 so that the axis 22 of the pull tab 20 is covered from the upper side by the substrate portion 31 of the leaf spring member 30. In this instance, the tongue portion 35 and the stopper claw portion 33 of the leaf spring member 30 are respectively inserted into the insertion hole 11*d* and the claw hole 11*e* of the upper blade 11, and the front end portion of the second post portion 11*c* of the slider body 10 is loosely inserted into the second window portion 37 of the leaf spring member 30. Accordingly, the tongue portion 35 of the leaf spring member 30 abuts against the first post portion 11*a* of the slider body 10, and the lower end portion of the drooping piece 32 of the leaf spring member 30 is slightly inserted into the front end groove 16 of the slider body 10.

Then, the leaf spring member 30 is pushed toward the slider body 10. Accordingly, the tongue portion 35 of the leaf spring member 30 is resiliently deformed and then is pushed down, and the protrusion 11*f* of the first post portion 11*a* of the slider body 10 is loosely inserted into the first window portion 36 of the leaf spring member 30. Simultaneously, the tongue portion 35 of the leaf spring member 30 is pressed against the abutment 11*f* of the first post portion 11*a*. Also, the first post portion 11*a* of the slider body 10 is inserted into the upper-surface window portion 34 of the leaf spring member 30, and the lateral edges of the upper-surface window portion 34 which are disposed at both right and left sides are set on the support portion 11*b* of the slider body 10.

Simultaneously, the drooping piece 32 of the leaf spring member 30 is pushed down while being guided along the front end groove 16 of the slider body 10, and the drooping piece 32 is resiliently deformed so that the lower end portion of the drooping piece 32 moves over the first locking portion 16*a* disposed on the front end groove 16 of the slider body 10. After that, as the lower end portion of the drooping piece 32 moves over the first locking portion 16*a* in the front end groove 16, the drooping piece 32 is resiliently deformed. In this way, the drooping piece 32 is inserted into the front end groove 16 of the slider body 10, and then abuts against the bottom surface of the front end groove. The first and second bosses 32*a* and 32*b* of the drooping piece 32 are respectively locked to the first and second locking portions 16*a* and 16*b* disposed on the front end groove 16 of the slider body 10.

Therefore, the leaf spring member 30 is fitted into the slider body 10 using the resilient force, thereby assembling the slider 1 of the first embodiment, as illustrated in FIGS. 3 and 4. In particular, in the slider 1 of the first embodiment, since the leaf spring member 30 is fitted into the slider body 10 in the state in which the pull tab 20 lies down toward the rear mouth (in the state in which the inclined angle $\alpha$ of the pull tab 20 is 0°), a gap is formed between the lower opened edges 36*a* and 37*a* of the first and second window portions 36 and 37 of the leaf spring member 30, and the bottom surfaces of the first and second post portions 11*a* and 11*c*, when the slider 1 is assembled. In this way, for example, even in the case where a tolerance occurs in the component dimensions of the slider body 10 or the leaf spring member 30, the leaf spring member 30 can be smoothly inserted into the slider body 10 without being caught by the latter, thereby reliably assembling the slider 1.

With the slider 1 of the first embodiment assembled as described above, as illustrated in FIG. 4, if the pull tab 20 lies down toward the rear mouth (rearward) (if the inclined angle $\alpha$ of the pull tab 20 is 0°), or if the pull tab 20 lies down toward the shoulder mouths (forward) (if the inclined angle $\alpha$ of the pull tab 20 is 180°), the lower opened edges 36*a* and 37*a* of the first and second window portions 36 and 37 are respectively spaced apart from the first and second post portions 11*a* and 11*c*, and, simultaneously, the stopper claw portion 33 of the leaf spring member 30 brings into a state (inserted state) of advancing into the element guide path 15 of the slider body 10.

For this reason, in the case of configuring the slide fastener using the slider 1 of the first embodiment, since the stopper claw portion 33 is inserted between the fastener elements of the element row by causing the pull tab 20 to lie down toward the rear mouth or the shoulder mouths, it is possible to hold the slider 1 at the stop position with respect to the element row.

Figure 5:
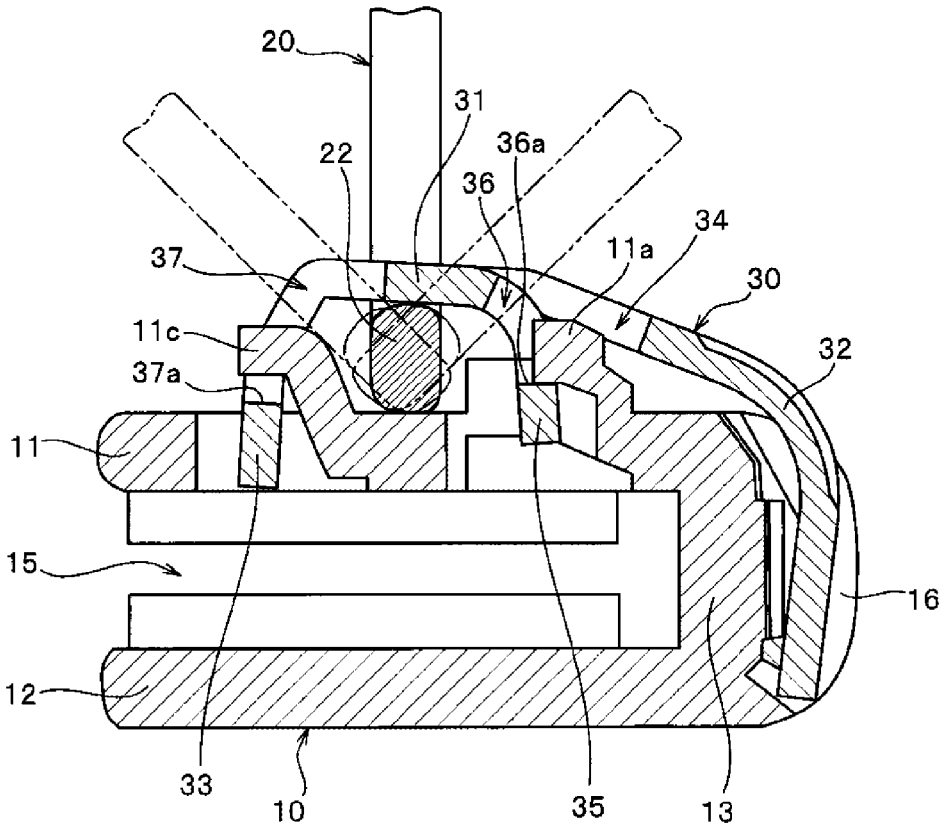
FIG. 5 is a cross-sectional view illustrating the slider in a state in which the pull tab is pivoted by manipulation.

In the slider 1 of the first embodiment, as illustrated in FIG. 5, when the pull tab 20 is stood up from the state in which the pull tab 20 lies down toward the rear mouth or the shoulder mouths, while the axis 22 of the pull tab 20 abuts against the upper surface of the upper blade 11, so that the inclined angle of the pull tab 20 is in the range of $0° < \alpha < 180°$, in particular, $30° \leq \alpha \leq 150°$, the substrate portion 31 of the leaf spring member 30 is lifted up against the resilient force of the leaf spring member 30 by the axis 22, having the cam-shaped cross section, of the pull tab 20. In this way, the bent portion of the drooping piece 32 of the leaf spring member 30 is resiliently deformed, and, simultaneously, the stopper claw portion 33 is lifted up to move out (get out) from the inside of the element guide path 15. Accordingly, the slider 1 can be freely slid with respect to the element row.

With the slider 1 according to the first embodiment, when the pull tab 20 is operated in the range of $0° < \alpha < 180°$, in particular, $30° \leq \alpha \leq 150°$ while the axis 22 of the pull tab 20 abuts against the upper surface of the upper blade 11, the substrate portion 31 of the leaf spring member 30 is lifted up by the axis 22. However, the lower opened edge 36*a* (first restricting portion) of the first window portion 36 can abut against the bottom surface of the first post portion 11*a*. In this way, it is possible to restrain the lower opened edge 36*a* from moving upward, thereby suppressing the leaf spring member 30 from being lifted up. Therefore, it is possible to suppress the deformation of the leaf spring member 30 (in particular, the bent portion of the leaf spring member 30) from being excessively increased.

In the first embodiment, when the pull tab 20 lies down backward (or forward) the spaced distance between the lower opened edge 37*a* of the second window portion 37 and the bottom surface of the front end portion of the second post portion 11*c* is set as two times or more, preferably, 3 times or more, as large as the spaced distance between the lower opened edge 36*a* of the first window portion 36 and the bottom surface of the front end portion of the first post portion 11*a*, as described above. For this reason, in the state in which the axis 22 of the pull tab 20 is contact with the upper surface of the upper blade 11, the state, in which the lower opened edge 37*a* of the second window portion 37 is spaced apart from the bottom surface of the second post portion 11*c*, is maintained, even though the lower opened edge 36*a* of the first window portion 36 abuts against the bottom surface of the front end portion of the first post portion 11*a*.

Further, when the slider 1 of the first embodiment is slid in the direction to engage the right and left element rows in the slide fastener, the pull tab 20 is further strongly pulled in the inclined angle $\alpha$ of, for example, $30° \leq \alpha \leq 150°$, from the state in which the axis 22 of the pull tab 20 abuts against the upper surface of the upper blade 11 and the lower opened edge 36*a* of the first window portion 36 abuts against the bottom surface of the first post portion 11*a*, and thus the axis 22 of the pull tab 20 may be spaced apart from the upper surface of the upper blade 11.

Figure 6:
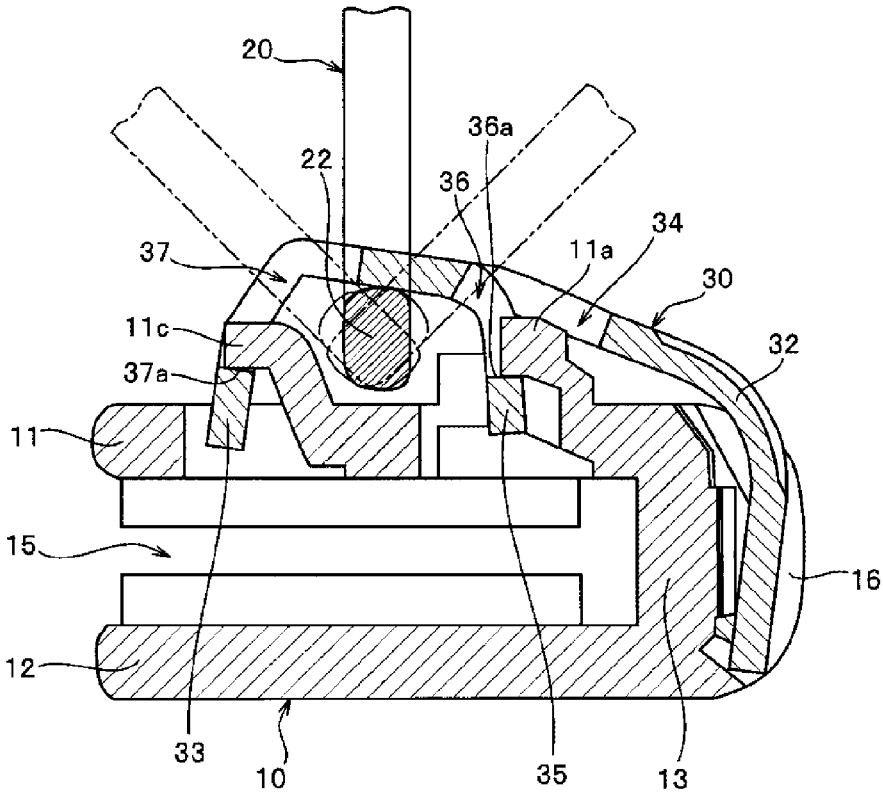
FIG. 6 is a cross-sectional view illustrating the slider in a state in which the pull tab is pulled so that an axis is spaced apart from an upper surface of an upper blade.

In this instance, as illustrated in FIG. 6, since the state, in which the lower opened edge 36*a* of the first window portion 36 abuts against the bottom surface of the first post portion 11*a*, is maintained, the bent portion of the leaf spring member 30 is suppressed from being resiliently deformed. However, the substrate portion 31 of the leaf spring member 30 is applied by strong force from the axis 22 of the pull tab 20 thereby to be resiliently deformed and thus be more lifted up.

In this instance, with the slider 1 of the first embodiment, while the state, in which the lower opened edge 36*a* of the first window portion 36 abuts against the bottom surface of the first post portion 11*a*, is maintained, the lower opened edge 37*a* (second restraining portion) of the second window portion 37 abuts against the bottom surface of the second post portion 11*c*, thereby restraining the lower opened edge 36*a* from being moved upward. In this way, even though the pull tab 20 is strongly pulled, the lower opened edges 36*a* and 37*a* of the first and second window portions 36 and 37 are respectively brought into contact with the first and second post portions 11*a* and 11*c*, thereby effectively restraining the lifting height of the leaf spring member 30. Therefore, it is possible to reliably suppress the whole leaf spring member 30 from being resiliently deformed more than necessary.

As described above, according to the slider 1 of the first embodiment, if the pull tab 20 is operated in the inclined angle $\alpha$ of $0° < \alpha < 180°$, from the state in which the axis 22 of the pull tab 20 abuts against the upper surface of the upper blade 11 (see FIG. 5), it is possible to suppress the leaf spring member 30 from being lifted up since the lower opened edge 36*a* of the first window portion 36 abuts against the first post portion 11*a*. Also, if the pull tab 20 is strongly pulled and thus the axis 22 of the pull tab 20 is spaced apart from the upper surface of the upper blade 11 (see FIG. 6), the lower opened edges 36*a* and 37*a* of the first and second window portions 36 and 37 are respectively brought into contact with the first and second post portions 11*a* and 11*c*, thereby effectively restraining the lifting height of the leaf spring member 30.

Accordingly, even though the slider 1 of the first embodiment is used for the slide fastener which is attached to, for example, clothing, and then the pull tab of the slider is repeatedly strongly pulled, the resilient deformation (strain) of the leaf spring member 30 can be suppressed to be small when the leaf spring member 30 is lifted up by the axis 22 of the pull tab 20. For this reason, the leaf spring member 30 can be prevented from being released from the slider body 10, and the deterioration of the leaf spring member 30 can be suppressed, so that the slider 1 can be reliably used for a long time.

In the leaf spring member 30 of the first embodiment, the first restraining portion for restraining the leaf spring member from moving upward due to abutment against the first post portion 11*a* of the slider body 10 and the second restraining portion for restraining the leaf spring member from moving upward due to abutment against the second post portion 11*c* of the slider body 10 are configured by the lower opened edge 36*a* of the first window portion 36 and the lower opened edge 37*a* of the second window portion 37 which are formed in the leaf spring member 30, respectively, but the configurations of the first and second restraining portions of the present invention are not limited thereto.

In the present invention, for example, the tongue portion of the leaf spring member may be provided with a first boss protruding toward the first post portion 11*a* of the slider body 10, instead of opening the first window portion, and the rear end portion of the substrate of the leaf spring member may be provided with a second boss protruding toward the second post portion 11*c* of the slider body 10, instead of opening the second window portion. The first boss and the second boss may be used as the first restraining portion and the second restraining portion, respectively.

Embodiment 2

Figure 7:
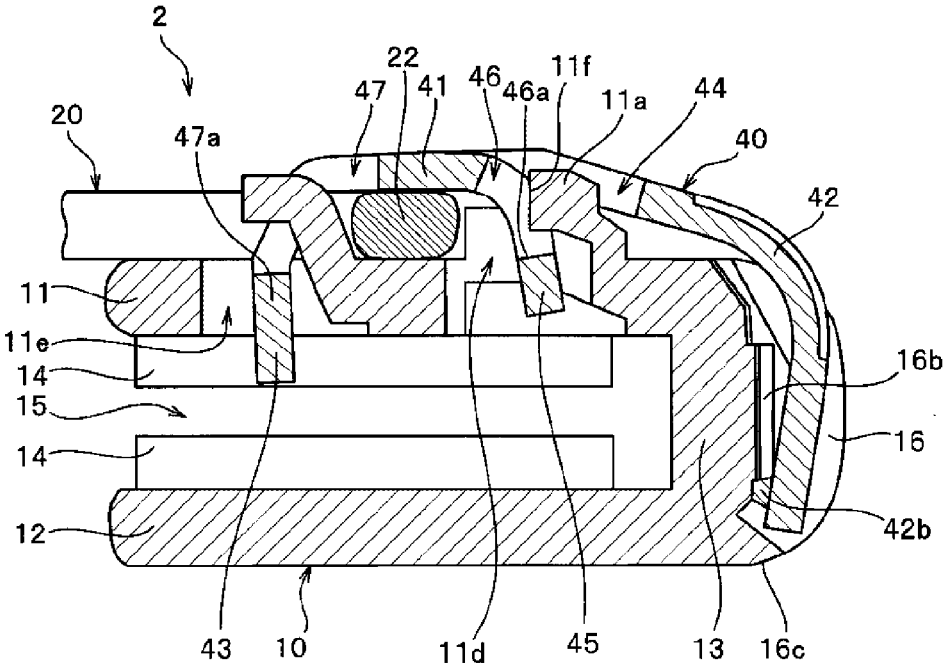
FIG. 7 is a cross-sectional view illustrating a state in which the pull tab lies down toward the rear mouth in a slider for a slide fastener according to a second embodiment of the present invention.
Figure 8:
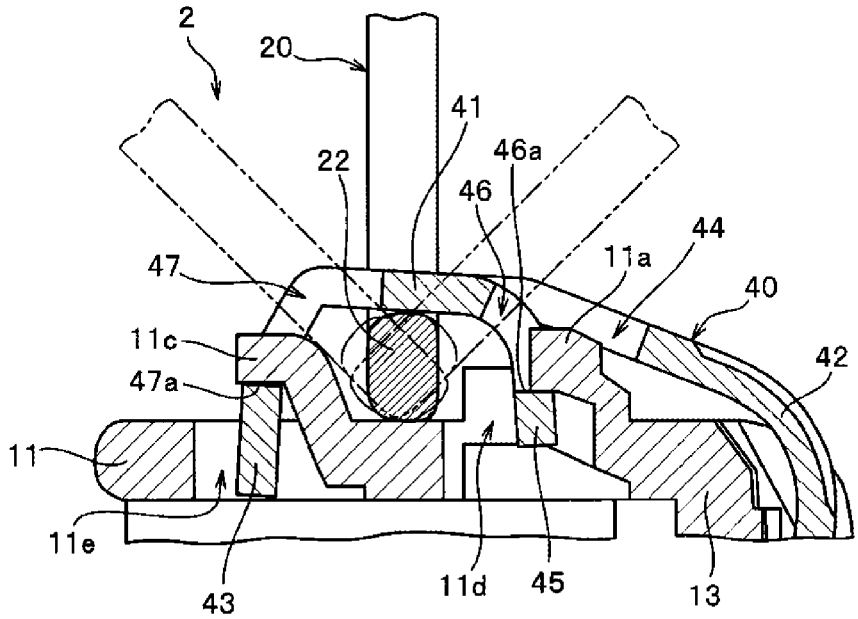
FIG. 8 is a cross-sectional view illustrating the slider in a state in which the pull tab is pivoted by manipulation.

FIG. 7 is a cross-sectional view illustrating a state in which the pull tab lies down toward the rear mouth in a slider for a slide fastener according to a second embodiment of the present invention. FIG. 8 is a cross-sectional view illustrating the slider in a state in which the pull tab is pivoted by manipulation.

The configuration of a slider 2 for a slide fastener according to the second embodiment is substantially identical to that of the above-described slider 1 according to the first embodiment, except that a relative positional relationship between lower opened edges 46*a* and 47*a* of first and second window portions 46 and 47 which are opened in a leaf spring member 40, and bottom surfaces of the first and second post portions 11*a* and 11*c* of the slider body 10 is different. In the following description on the second exemplary embodiment and third and fourth embodiments which will be described later, like reference numerals are attached to elements identical to those in the first exemplary embodiment and the description thereof is omitted.

The slider 2 according to the second embodiment includes three components, that is, a slider body 10, a pull tab 20 rotatably attached to the slider body 10, and leaf spring member 40 fitted into the slider body 10. Similar to the above-described first embodiment, the slider includes a stop mechanism employing a stopper claw portion 43, which will be described later, of the leaf spring member 40.

The leaf spring member 40 of the second embodiment is made of a sheet of the same stainless steel as that configuring the leaf spring member 30 of the above-described embodiment 1, and is formed such that a longitudinal section is bent in a substantially C-shape. The leaf spring member 40 has a substrate portion 41, a drooping piece 42 extending from a front end portion of the substrate portion 41, and a stopper claw portion 43 extending downward from a rear end portion of the substrate portion 41.

On the substrate portion 41, an upper-surface window portion 44 is opened, and a tongue portion 45 inclined downward toward the front extends from a rear opened edge of the upper-surface window portion 44. A first window portion 46 is opened in the tongue portion 45, and a second window portion 47 is opened from the substrate portion 41 to the stopper claw portion 43. A front end portion of the drooping piece 42 of the leaf spring member 40 is provided at its lower end thereof with a first boss (not illustrated) protruding in a right and left direction, and a second boss protruding in a rearward direction.

The first window portion 46 of the second embodiment is adapted to have a widthwise opening size larger than a widthwise size (width dimension) of the protrusion 11*f*, in order to loosely fit the protrusion 11*f* disposed on the first post portion 11*a* of the slider body 10 when the slider 2 is assembled.

The lower opened edge 46*a* of the first window portion 46 is disposed at a position to be spaced apart from the first post portion 11*a* when the pull tab 20 lies down backward at its inclined angle $\alpha$ of 0° or when the pull tab 20 lies down forward at its inclined angle $\alpha$ of 180°. Further, the lower opened edge 46*a* of the first window portion 46 is disposed as a first restraining portion at a position in which the lower opened edge 46*a* abuts against the bottom surface of the front end portion of the first post portion 11*a* when the pull tab 20 is operated in a range of $0° < \alpha < 180°$, preferably, $30° \leq \alpha \leq 150°$.

The second window portion 47 of the second embodiment is adapted to have a widthwise opening size larger than the width dimension of the front end portion of the second post portion 11*c*, in order to loosely fit the front end portion of the second post portion 11*c* disposed at the slider body 10 when the slider is assembled.

The lower opened edge 47*a* of the second window portion 47 is disposed at a position to be spaced apart from the second post portion 11*c* when the pull tab 20 lies down backward at its inclined angle $\alpha$ of 0° or when the pull tab 20 lies down forward at its inclined angle $\alpha$ of 180°. Further, the lower opened edge 47*a* of the second window portion 47 is disposed at a position, for example, higher than the lower opened edge 37*a* of the second window portion 37 in the above-described first embodiment, and is disposed as a second restraining portion in which the lower opened edge 46*a* of the first window portion 46 abuts against the bottom surface of the front end portion of the first post portion 11*a*, and, simultaneously, abuts against the bottom surface of the front end portion of the second post portion 11*c*, when the pull tab 20 is operated in the range of which the inclined angle of the pull tab 20 is $0° < \alpha < 180°$, preferably, $30° \leq \alpha \leq 150°$.

With the slider 2 including the above configuration according to the second embodiment, as illustrated in FIG. 7, if the pull tab 20 lies down toward the rear mouth (backward) (if the inclined angle $\alpha$ of the pull tab 20 is 0°), or if the pull tab 20 lies down toward the shoulder mouths (forward) (if the inclined angle $\alpha$ of the pull tab 20 is 180°), the lower opened edges 46*a* and 47*a* of the first and second window portions 46 and 47 are respectively spaced apart from the first and second post portions 11*a* and 11*c*, and, simultaneously, the stopper claw portion 43 of the leaf spring member 40 brings into a state of advancing into the element guide path 15 of the slider body 10. As a result, the stop mechanism of the slider 2 operates.

In the slider 2 of the second embodiment, as illustrated in FIG. 8, when the pull tab 20 is stood up from the state in which the pull tab 20 lies down toward the rear mouth or the shoulder mouths, while the axis 22 of the pull tab 20 abuts against the upper surface of the upper blade 11, so that the inclined angle of the pull tab 20 is in the range of $0° < \alpha < 180°$, in particular, $30° \leq \alpha \leq 150°$, the substrate portion 41 of the leaf spring member 40 is lifted up against the resilient force of the leaf spring member 40 by the axis 22 of the pull tab 20. Accordingly, since the stopper claw portion 43 is lifted up, and thus moves out from the element guide path 15, the slider 2 can be freely slid with respect to the element row.

In this instance, with the slider 2 of the second embodiment, the lower opened edges 46*a* and 47*a* of the first and second window portions 46 and 47 are simultaneously brought into contact with the bottom surfaces of the first and second post portions 11*a* and 11*c*. In this way, it is possible to effectively restrain the lifting height of the leaf spring member 30, and thus, the leaf spring member 40 can be reliably suppressed from being resiliently deformed more than necessary.

As described above, according to the slider 2 of the second embodiment, when the pull tab 20 is stoop up from the lying-down state, the lower opened edges 46*a* and 47*a* of the first and second window portions 46 and 47 simultaneously abut against the first and second post portions 11*a* and 11*c*, thereby effectively restraining the lifting height of the leaf spring member 30. For this reason, even though the pull tab 20 is further strongly pulled from the state in which the axis 22 of the pull tab 20 abuts against the upper surface of the upper blade 11 and the lower opened edges 46*a* and 47*a* of the first and second window portions 46 and 47 abut against the first and second post portions 11*a* and 11*c*, the leaf spring member 40 can be suppressed from being lifted up so that the axis 22 of the pull tab 20 is spaced apart from the upper surface of the upper blade 11. As a result, the resilient deformation (resilient strain) of the leaf spring member 40 can be suppressed to be small.

Embodiment 3

Figure 9:
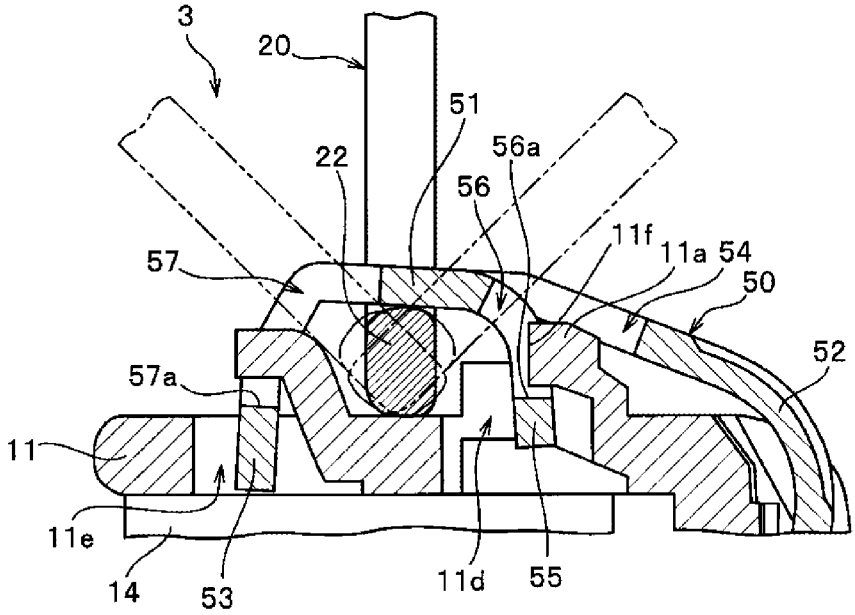
FIG. 9 is a cross-sectional view illustrating a state in which the pull tab is inclined toward the rear mouth in a slider for a slide fastener according to a third embodiment of the present invention.

FIG. 9 is a cross-sectional view illustrating a state in which the pull tab is inclined toward the rear mouth in a slider for a slide fastener according to the third embodiment of the present invention.

A slider 3 according to the third embodiment includes three components, that is, a slider body 10, a pull tab 20 rotatably attached to the slider body 10, and a leaf spring member 40 fitted into the slider body 10. Also, the slider includes a stop mechanism employing a stopper claw portion 53, which will be described later, of the leaf spring member 50.

The leaf spring member 50 of the third embodiment has a substrate portion 51, a drooping piece 52 extending from a front end portion of the substrate portion 51, and a stopper claw portion 53 extending downward from a rear end portion of the substrate portion 51. Further, on the substrate portion 51, an upper-surface window portion 54 is opened, and a tongue portion 55 extends from a rear opened edge of the upper-surface window portion 54. A first window portion 56 is opened in the tongue portion 55, and a second window portion 57 is opened from the substrate portion 51 to the stopper claw portion 53. A front end portion of the drooping piece 52 of the leaf spring member 50 is provided at its lower end thereof with first and second bosses (not illustrated), like the above-described first embodiment.

The first window portion 56 of the leaf spring member 50 is set to have a widthwise opening size larger than a widthwise size of the protrusion 11*f* of the first post portion 11*a* of the slider body 10, and the second window portion 57 is set to have a widthwise opening size larger than the width dimension of the front end portion of the second post portion 11*c* of the slider body 10.

In the leaf spring member 50, lower opened edges 56*a* and 57*a* of the first and second window portions 56 and 57 are disposed at a position to be respectively spaced apart from the first and second post portions 11*a* and 11*c*, when the pull tab 20 lies down backward at its inclined angle $\alpha$ of 0° or when the pull tab 20 lies down forward at its inclined angle $\alpha$ of 180°, and, as illustrated in FIG. 9, when the pull tab 20 is operated in a range of $0° < \alpha < 180°$, while the axis 22 of the pull tab 20 abuts against the upper surface of the upper blade 11.

Lower opened edges 56*a* and 57*a* of the first and second window portions 56 and 57 are disposed as first and second restraining portions at positions which respectively abut against the bottom surface of the front end portion (protrusion 11*f*) of the first post portion 11*a* and the bottom surface of the front end portion of the second post portion 11*c* when the pull tab 20 is pulled and thus the axis 22 of the pull tab 20 is spaced apart from the upper surface of the upper blade 11.

In the third embodiment, the lower opened edge 57*a* of the second window portion 57 is configured to abut against the bottom surface of the second post portion 11*c*, at the same time when the lower opened edge 56*a* of the first window portion 56 abuts against the bottom surface of the post portion 11*a* in a case where the pull tab 20 is pulled and thus the axis 22 of the pull tab 20 is spaced apart from the upper surface of the upper blade 11, or when the substrate portion 31 of the leaf spring member 30 is further lifted by the axis 22 of the pull tab 20 from the state in which the lower opened edge 56*a* of the first window portion 56 abuts against the bottom surface of the first post portion 11*a*.

With the slider 3 including the above configuration according to the third embodiment, if the pull tab 20 lies down toward the rear mouth (rearward), or if the pull tab 20 lies down toward the shoulder mouths (forward), the lower opened edges 56*a* and 57*a* of the first and second window portions 56 and 57 are respectively spaced apart from the first and second post portions 11*a* and 11*c*, and, simultaneously, the stopper claw portion 53 of the leaf spring member 50 brings into a state of advancing into the element guide path 15 of the slider body 10. As a result, the stop mechanism of the slider 3 operates.

In the slider 3 of the third embodiment, as illustrated in FIG. 9, when the pull tab 20 is stood up from the state in which the pull tab 20 lies down toward the rear mouth or the shoulder mouths, while the axis 22 of the pull tab 20 abuts against the upper surface of the upper blade 11, so that the inclined angle of the pull tab 20 is in the range of $0° < \alpha < 180°$, in particular, $30° \leq \alpha \leq 150°$, the substrate portion 51 of the leaf spring member 50 is lifted up against the resilient force of the leaf spring member 50 by the axis 22 of the pull tab 20. Accordingly, since the stopper claw portion 53 is lifted up, and thus moves out from the element guide path 15, the slider 3 can be freely slid with respect to the element row.

In this instance, if the pull tab 20 is operated in the inclined angle $\alpha$ of $0° < \alpha < 180°$ while the axis 22 of the pull tab 20 abuts against the upper surface of the upper blade 11, in the third embodiment, the lower opened edges 56*a* and 57*a* of the first and second window portions 56 and 57 are respectively spaced apart from the bottom surfaces of the first and second post portions 11*a* and 11*c*.

Meanwhile, at the time of the operation of the pull tab 20, if the pull tab 20 is strongly pulled and thus the axis 22 of the pull tab 20 is spaced apart from the upper surface of the upper blade 11, the lower opened edges 56*a* and 57*a* of the first and second window portions 56 and 57 can respectively abut against the bottom surfaces of the first and second post portions 11*a* and 11*c*. In this way, the lifting height of the leaf spring member 50 can be restrained, thereby suppressing the leaf spring member 50 from being resiliently deformed more than necessary. Accordingly, the leaf spring member 50 can be prevented from being released from the slider body 10, and the deterioration of the leaf spring member 50 can be delayed to maintain the normal operation of the stop mechanism, so that the slider 3 can be reliably used for a long time.

Embodiment 4

Figure 10:
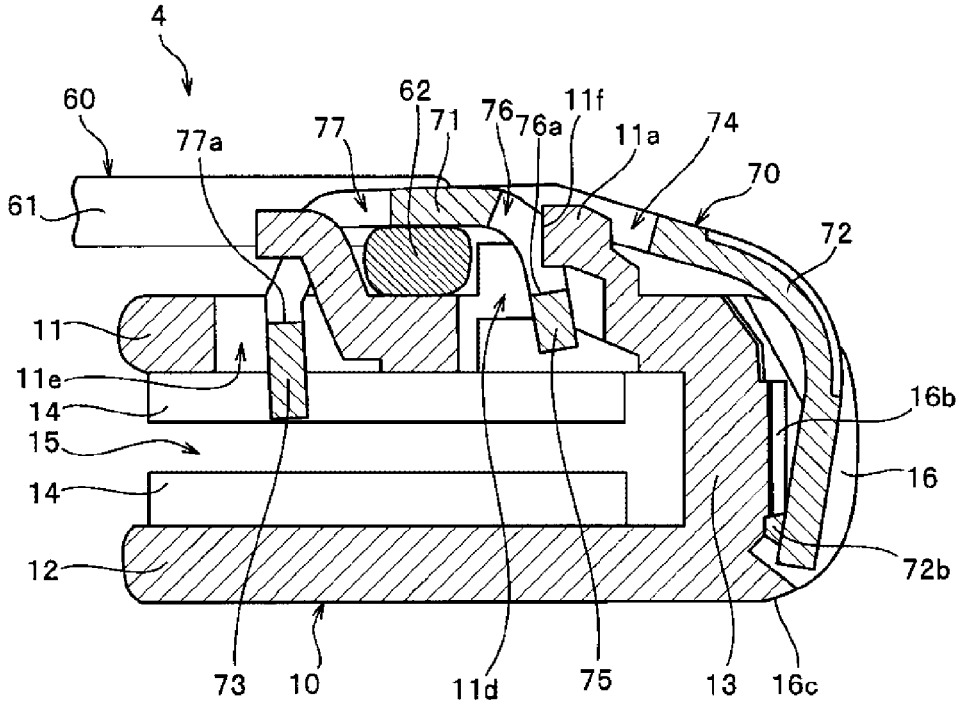
FIG. 10 is a cross-sectional view illustrating a state in which the pull tab lies down toward the rear mouth in a slider for a slide fastener according to a fourth embodiment of the present invention.
Figure 11:
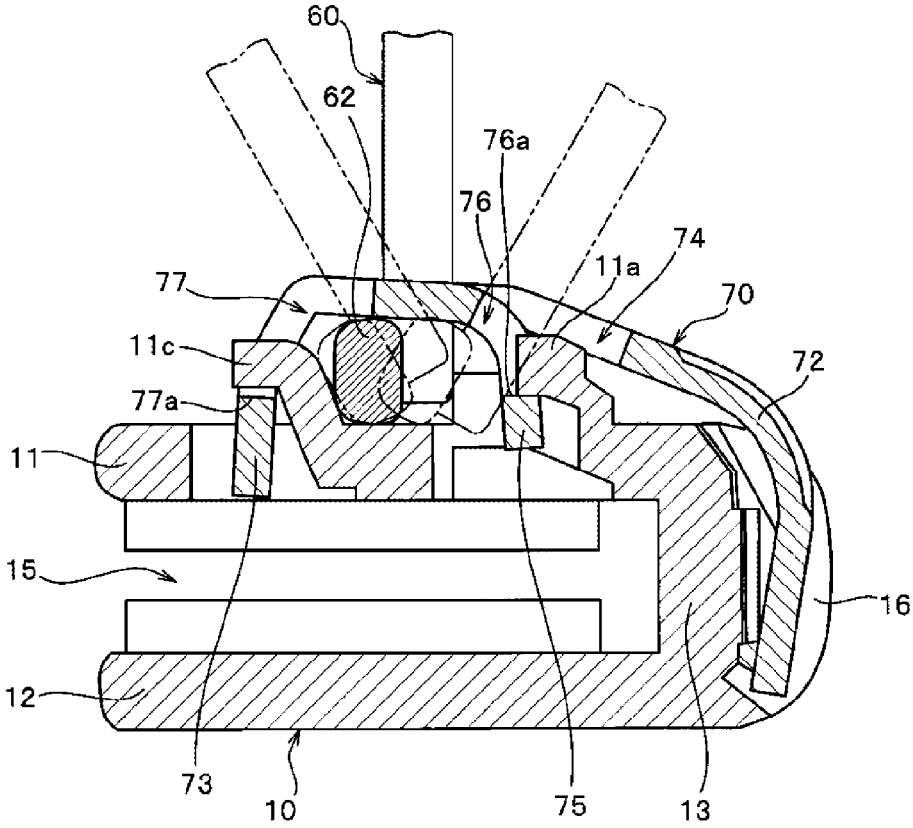
FIG. 11 is a cross-sectional view illustrating the slider in a state in which the pull tab is pivoted by manipulation.
Figure 12:
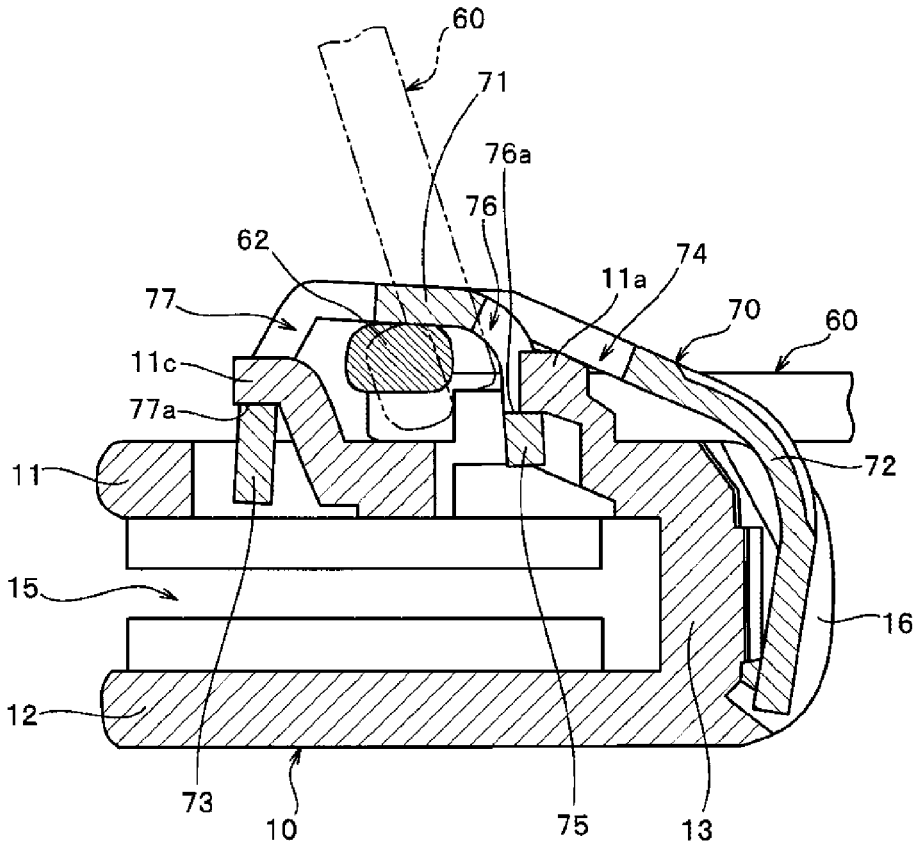
FIG. 12 is a cross-sectional view illustrating the slider in a state in which the pull tab lies down toward shoulder mouths.
Figure 13:
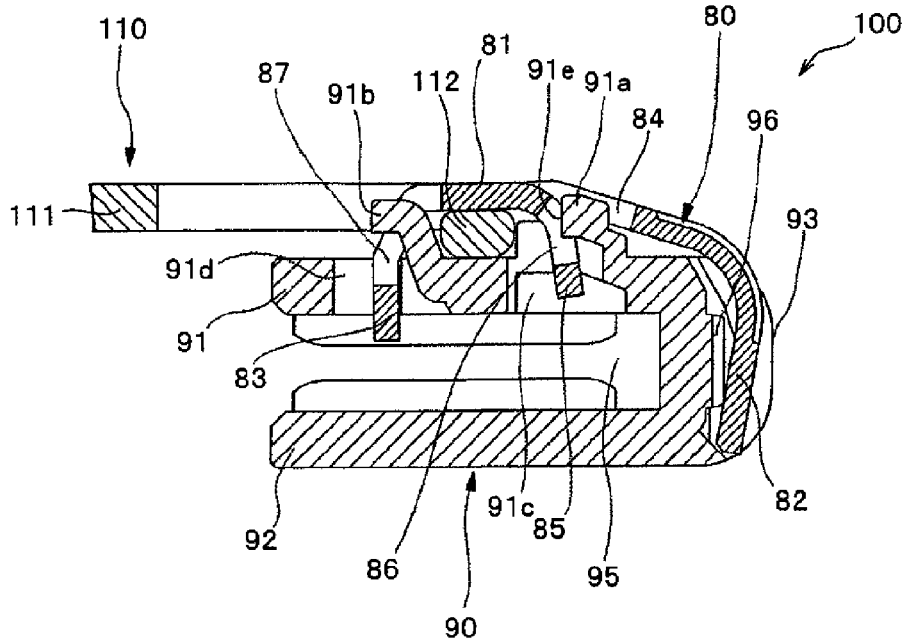
FIG. 13 is a cross-sectional view illustrating a slider for a slide fastener of the related art.

FIG. 10 is a cross-sectional view illustrating a state in which the pull tab lies down toward the rear mouth in a slider for a slide fastener according to the fourth embodiment of the present invention. FIG. 11 is a cross-sectional view illustrating the slider in a state in which the pull tab is pivoted by manipulation. FIG. 12 is a cross-sectional view illustrating the slider in a state in which the pull tab lies down toward shoulder mouths.

A slider 4 according to the fourth embodiment includes three components, that is, a slider body 10, a pull tab 20 rotatably attached to the slider body 10, and a leaf spring member 70 fitted into the slider body 10. Also, the slider includes a stop mechanism employing a stopper claw portion 73, which will be described later, of the leaf spring member 70.

The pull tab 40 of the fourth embodiment includes a pull tab body 61 to be pinched by fingers at operation of the slider 4, and an axis 22 disposed at one end portion of the pull tab body 61 and having a cam-shaped cross section. Also, the pull tab 60 of the fourth embodiment is configured so that a center surface of the pull tab body 61 in a thickness direction thereof is disposed parallel with a center surface of the axis 22 in a thickness direction thereof on a different surface. The pull tab 60 is configured so that the axis 62 is shifted downward with respect to the pull tab body 61 when the pull tab 60 lies down toward the rear mouth of the slider body 10.

The leaf spring member 70 of the fourth embodiment has a substrate portion 71, a drooping piece 72 extending from a front end portion of the substrate portion 71, and a stopper claw portion 73 extending downward from a rear end portion of the substrate portion 71. On the substrate portion 71, an upper-surface window portion 74 is opened, and a tongue portion 75 extends from a rear opened edge of the upper-surface window portion 74. The first window portion 76 is opened in the tongue portion 75, and a second window portion 77 is opened from the substrate portion 71 to the stopper claw portion 73. The leaf spring member 70 is provided with a first boss (not illustrated) protruding in a right and left direction and a second boss 72*b* protruding in a backward direction at a lower end of the front end portion of the drooping piece 72.

The first window portion 76 of the leaf spring member 70 is adapted to have a widthwise opening size larger than a widthwise size of the protrusion 11*f* on the first post portion 11*a* of the slider body 10. The second window portion 77 is adapted to have a widthwise opening size larger than a widthwise size of the front end portion of the second post portion 11*c* of the slider body 10.

The lower opened edge 76*a* of the first window portion 76 is disposed at a position to be spaced apart from the first post portion 11*a* when the pull tab 60 lies down backward at its inclined angle $\alpha$ of 0°. Further, the lower opened edge 76*a* is disposed as a first restraining portion at a position in which the lower opened edge 76*a* abuts against the bottom surface of the projection 11*f* of the first post portion 11*a* when the pull tab 20 is operated in a range of $0° < \alpha < 180°$, preferably, $30° \leq \alpha \leq 150°$.

In the fourth embodiment, since the axis 62 of the pull tab 60 is disposed to be shifted with respect to the pull tab body 61, as illustrated in FIG. 12, if the pull tab 60 lies down forward at the inclined angle $\alpha$ of 180°, the axis 62 of the pull tab 60 is spaced apart from the upper surface of the upper blade, and thus the substrate portion 71 of the leaf spring member 70 is lifted up by the axis 62. For this reason, the lower end edge 76*a* of the first window portion 76 is configured to abut against the bottom surface of the projection 11*f* of the first post portion 11*a* even when the pull tab 60 lies down forward.

Meanwhile, the lower opened edge 77*a* of the second window portion 77 is disposed at a position to be spaced apart from the second post portion 11*c* when the pull tab 60 lies down backward at its inclined angle $\alpha$ of 0°. Further, the lower opened edge 77*a* of the second window portion 77 is disposed as a second restraining portion in which the lower opened edge abuts against the bottom surface of the front end portion of the second post portion 11*c*, as illustrated in FIG. 12, when the pull tab 60 is operated to further lift the substrate portion 71 of the leaf spring member 70 from the state in which the lower opened edge 76*a* of the first window portion 76 abuts against the first post 11*a*, and thus the axis 62 of the pull tab 60 is spaced apart from the upper surface of the upper blade 11, or when the pull tab 60 lies down forward at the inclined angle of 180°.

With the slider 4 including the above configuration according to the fourth embodiment, as illustrated in FIG. 10, if the pull tab 60 lies down toward the rear mouth, the lower opened edges 76*a* and 77*a* of the first and second window portions 76 and 77 are respectively spaced apart from the first and second post portions 11*a* and 11*c*, and, simultaneously, the stopper claw portion 73 of the leaf spring member 70 brings into a state of advancing into the element guide path 15 of the slider body 10, so that the stop mechanism of the slider 4 operates.

In the slider 4 of the fourth embodiment, as illustrated in FIG. 11, when the pull tab 60 is stood up from the state in which the pull tab 60 lies down toward the rear mouth, while the axis 62 of the pull tab 60 abuts against the upper surface of the upper blade 11, so that the inclined angle of the pull tab 60 is in the range of $0° < \alpha < 180°$, in particular, $30° \leq \alpha \leq 150°$, the substrate portion 71 of the leaf spring member 70 is lifted up by the axis 62 of the pull tab 60. In this way, since the stopper claw portion 73 is lifted up to move out from the element guide path 15, the slider 4 can be freely slid with respect to the element row.

When the pull tab 60 is operated in the range of $0° < \alpha < 180°$, in particular, $30° \leq \alpha \leq 150°$ while the axis 62 of the pull tab 60 abuts against the upper surface of the upper blade 11, the lower opened edge 76*a* of the first window portion 76 can abut against the bottom surface of the first post portion 11*a* in the slider 4 according to the fourth embodiment. In this way, the lifting height of the leaf spring member 70 can be restrained, thereby suppressing the deformation of the leaf spring member 70 (in particular, the bent portion of the leaf spring member 70) from being excessively increased. In this instance, in the fourth embodiment, if the axis 62 of the pull tab 60 is contact with the upper surface of the upper blade 11, the state in which the lower opened edge 77*a* of the second window portion 77 of the leaf spring member 70 is spaced apart from the bottom surface of the second post portion 11*c* is maintained.

Further, in the slider 4 according to the fourth embodiment, when the pull tab 60 is further strongly pulled from the state in which the axis 62 of the pull tab 60 abuts against the upper surface of the upper blade 11 and the lower opened edge 76*a* of the first window portion 76 of the leaf spring member 70 abuts against the bottom surface of the first post portion 11*a*, as indicated by the imaginary line in FIG. 12, the axis 62 of the pull tab 60 may be spaced apart from the upper surface of the upper blade 11.

In this instance, in the slider 4 according to the fourth embodiment, the lower opened edge 77*a* of the second window portion 76 can abut against the bottom surface of the second post portion 11*c*, while the lower opened edge 76*a* of the first window portion 76 abuts against the first post portion 11*a*. In this way, the lifting height of the leaf spring member 70 can be effectively restrained, thereby suppressing the whole leaf spring member 70 from being resiliently deformed more than necessary.

In the slider 4 of the fourth embodiment, when the pull tab 60 lies down forward, as described above, the axis 62 of the pull tab 60 is spaced apart from the upper surface of the upper blade 11, so that the substrate portion 71 of the leaf spring member 70 is lifted up by the axis 62. Therefore, since the stopper claw portion 73 is lifted up, and thus moves out from the element guide path 15, the slider 4 can be freely slid with respect to the element row.

In this instance, the lower opened edges 76*a* and 77*a* of the first and second window portions 76 and 77 are respectively brought into contact with the first and second post portions 11*a* and 11*c*, thereby restraining the lifting height of the leaf spring member 70. Therefore, it is possible to suppress the whole leaf spring member 70 from being resiliently deformed more than necessary.

DESCRIPTION OF REFERENCE NUMERALS

1: Slider
2: Slider
3: Slider
4: Slider
10: Slider Body
11: Upper Blade
11*a*: First Post Portion
11*b*: Support Portion
11*c*: Second Post Portion

11*d*: Insertion Hole
11*e*: Claw Hole
11*f*: Projection
11*g*: Abutment Portion
12: Lower Blade
13: Guide Post
14: Flange Portion
15: Element Guide Path
16: Front End Groove
16*a*: First Locking Portion
16*b*: Second Locking Portion
16*c*: Lower Wall Portion
20: Pull Tab
21: Pull Tab Body
22: Pintle
30: Leaf Spring Member
31: Substrate Portion
32: Drooping Piece
32*a*: First Boss
32*b*: Second Boss
33: Stopper Claw Portion
34: Upper Window Portion
35: Tongue Portion
36: First Window Portion
36*a*: Lower Opened Edge
37: Second Window Portion
37*a*: Lower Opened Edge
40: Leaf Spring Member
41: Substrate Portion
42: Drooping Piece
42*b*: Second Boss
43: Stopper Claw Portion
44: Upper Window Portion
45: Tongue Portion
46: First Window Portion
46*a*: Lower Opened Edge
47: Second Window Portion
47*a*: Lower Opened Edge
50: Leaf Spring Member
51: Substrate Portion
52: Drooping Piece
53: Stopper Claw Portion
54: Upper Window Portion
55: Tongue Portion
56: First Window Portion
56*a*: Lower Opened Edge
57: Second Window Portion
57*a*: Lower Opened Edge
60: Pull Tab
61: Pull Tab Body
62: Pintle
70: Leaf Spring Member
71: Substrate Portion
72: Drooping Piece
72*b*: Second Boss
73: Stopper Claw Portion
74: Upper Window Portion
75: Tongue Portion
76: First Window Portion
76*a*: Lower Opened Edge
77: Second Window Portion
77*a*: Lower Opened Edge

The invention claimed is:

1. A slider for a slide fastener with a stop mechanism, comprising:

a slider body having upper and lower blades and a guide post for connecting front end portions of the upper and lower blades;

a pull tab having an axis at one end portion of a pull tab body; and a bent leaf spring member, wherein the upper blade includes a claw hole formed at a side of the rear mouth of the slider body, a first post portion standing up at a front side with respect to the claw hole, and a second post portion standing up at a rear side with respect to the first post portion, wherein the leaf spring member includes a substrate portion pushing the axis of the pull tab from an upper side, a stopper claw portion extending from a rear end portion of the substrate portion, and a tongue portion extending downward from the substrate portion, and the leaf spring member is fitted into the slider body such that the stopper claw portion is able to be inserted into or released from an element guide path of the slider body by rotation of the pull tab, wherein the pull tab is configured such that a center surface of the pull tab body in a thickness direction thereof is disposed flush with a center surface of the axis in a thickness direction thereof, wherein the leaf spring member includes a first restraining portion which is disposed at the tongue portion and abuts against the first post portion to restrain upward movement of the leaf spring member, and a second restraining portion which is disposed on the substrate portion at a side of the stopper claw portion with respect to the tongue portion, and abuts against the second post portion to restrain the upward movement of the leaf spring member, wherein if an inclined angle a of the pull tab with respect to an upper surface of the upper blade is defined as 0° when the pull tab lies down backward, the first and second restraining portions are respectively disposed at positions to be spaced apart from the first and second post portions when the inclined angle $\alpha$ of the pull tab is in a range of $0° \leq \alpha \leq 180°$ while the axis of the pull tab abuts against the upper surface of the upper blade, and wherein the first and second restraining portions are disposed in a relation to respectively abut against the first post portion and the second post portion, and thus restrain the upward movement, when the axis of the pull tab is spaced apart from the upper blade, wherein the second restraining portion is disposed in a relation to abut against the second post portion and thus restrain the upward movement, when the pull tab is operated to further lift up the substrate portion of the leaf spring member from a state in which the first restraining portion abuts against the first post portion and thus the upward movement is restrained or while the first restraining portion abuts against the first post portion to restrain the upward movement.

2. The slider for the slide fastener according to claim 1, wherein front end portions of the first and second post portions are bent, wherein a first window portion is opened in the tongue portion, and a second window portion is opened in the substrate portion at the side of the stopper claw portion with respect to the tongue portion, wherein the front end portions of the first and second post portions are loosely inserted into the first and second windows of the leaf spring member, respectively, wherein the first and second restraining portions are respectively configured by lower opened edges of the first and second windows, wherein the front end portion of the first post portion has a protrusion disposed at a center portion in a width direction and an abutment portion disposed at both right and left sides of the protrusion, and wherein the tongue portion is pressed against the abutment portion of the first post portion.

3. The slider for the slide fastener according to claim 1, wherein the leaf spring member is made of stainless steel having yield strength of 1500N/mm$^2$ or more.

4. The slider for the slide fastener according to claim 1, wherein the leaf spring member is made of stainless steel having hardness of 430Hv or more and 500Hv or less.

5. The slider for the slide fastener according to claim 1, wherein the leaf spring member has magnetic permeability of 1.005 or less.

* * * * *

UNITED STATES PATENT AND TRADEMARK OFFICE

CERTIFICATE OF CORRECTION

PATENT NO. : 8,782,857 B2
APPLICATION NO. : 13/821688
DATED : July 22, 2014
INVENTOR(S) : Keiichi Keyaki et al.

It is certified that error appears in the above-identified patent and that said Letters Patent is hereby corrected as shown below:

In the Specification

In column 1, line 66, delete "9b" and insert -- 91b --, therefor.

In column 10, line 43-53, delete "Further, the lower opened edge 36a of the first window portion 36 is disposed at a position in which the lower opened edge 36a abuts against the bottom surface of the front end portion (protrusion 110 of the first post portion 11a when the pull tab 20 is operated in a range of 0.degree.<.alpha.<180.degree., preferably, 30.degree.<.alpha.<150.degree.. Accordingly, the lower opened edge 36a of the first window portion 36 abuts against the bottom surface of the front end portion of the first post portion 11a when the pull tab 20 is operated in the range, which functions as a first restraining which restrains the movement of the lower opened edge 36a to a position higher than the abutment position." and insert the same on Col. 10, Line 42, after "180°." as the continuation of the same Paragraph.

In column 10, line 46, delete "110" and insert -- 11f) --, therefor.

In column 10, line 48, delete "30°<α<150°." and insert -- 30°≤α≤150°. --, therefor.

In the Claims

In column 22, line 36, in claim 1, delete "a" and insert -- α --, therefor.

Signed and Sealed this
Twenty-eighth Day of October, 2014

Michelle K. Lee

Michelle K. Lee
*Deputy Director of the United States Patent and Trademark Office*